US008550785B2

(12) United States Patent
Afanasiev et al.

(10) Patent No.: US 8,550,785 B2
(45) Date of Patent: Oct. 8, 2013

(54) WIRE SEAL FOR METERING OF TURBINE BLADE COOLING FLUIDS

(75) Inventors: Gennadiy Afanasiev, Windermere, FL (US); Dieter Brillert, Rodgau (DE)

(73) Assignee: Siemens Energy, Inc., Orlando, FL (US)

( * ) Notice: Subject to any disclaimer, the term of this patent is extended or adjusted under 35 U.S.C. 154(b) by 430 days.

(21) Appl. No.: 13/020,074

(22) Filed: Feb. 3, 2011

(65) Prior Publication Data

US 2011/0305561 A1 Dec. 15, 2011

Related U.S. Application Data

(60) Provisional application No. 61/353,730, filed on Jun. 11, 2010.

(51) Int. Cl.

| | |
|---|---|
| ***F01D 5/02*** | (2006.01) |
| ***F01D 5/30*** | (2006.01) |
| ***F04D 29/26*** | (2006.01) |

(52) U.S. Cl.
USPC ..... 416/204 A

(58) Field of Classification Search
USPC .... 415/180; 416/96 A, 193 A, 196 A, 204 A, 416/204 R, 218, 220 R, 221, 248; 227/412
See application file for complete search history.

(56) References Cited

U.S. PATENT DOCUMENTS

| | | | | |
|---|---|---|---|---|
| 4,021,138 | A * | 5/1977 | Scalzo et al. | 416/95 |
| 4,484,858 | A | 11/1984 | Kurosawa et al. | |
| 5,257,909 | A * | 11/1993 | Glynn et al. | 416/220 R |
| 5,288,210 | A | 2/1994 | Albrecht et al. | |
| 5,472,313 | A | 12/1995 | Quinones et al. | |
| 6,000,909 | A | 12/1999 | Hirokawa et al. | |
| 6,017,189 | A | 1/2000 | Judet et al. | |
| 6,375,429 | B1 | 4/2002 | Halila et al. | |
| 6,682,307 | B1 | 1/2004 | Tiemann | |
| 6,726,452 | B2 | 4/2004 | Strassberger et al. | |
| 6,769,867 | B2 | 8/2004 | Uematsu et al. | |
| 7,097,429 | B2 | 8/2006 | Athans et al. | |
| 7,131,813 | B2 | 11/2006 | Tiemann | |
| 7,234,918 | B2 | 6/2007 | Brillert et al. | |
| 7,371,050 | B2 * | 5/2008 | Pasquiet | 416/204 A |
| 7,549,835 | B2 | 6/2009 | Brillert | |
| 7,566,201 | B2 | 7/2009 | Brillert et al. | |
| 7,607,889 | B2 | 10/2009 | Baldauf et al. | |
| 7,717,671 | B2 | 5/2010 | Addis | |
| 2005/0232772 | A1 | 10/2005 | Race et al. | |

(Continued)

FOREIGN PATENT DOCUMENTS

| | | |
|---|---|---|
| DE | 1182474 | 11/1964 |
| EP | 0833039 A1 | 4/1998 |
| GB | 2221724 A | 2/1990 |
| JP | 2005299670 | 10/2005 |

*Primary Examiner* — Edward Look
*Assistant Examiner* — Christopher C Williams

(57) ABSTRACT

A cooling fluid metering system for a turbine blade of a gas turbine engine is disclosed. The cooling fluid metering system may include a cooling channel positioned between a root of a turbine blade and an offset rotor sealing plate for supplying cooling fluids to turbine blades. At one point, a portion of the cooling channel may include a gap between the root and the offset rotor sealing plate. The gap may be sealed with teardrop shaped seal positioned within a teardrop shaped cavity at the gap. The cavity and seal may be positioned such that during operation, the seal is forced radially outward and into the gap, thereby effectively metering cooling fluid flow through the cooling channel.

20 Claims, 3 Drawing Sheets

(56) References Cited

U.S. PATENT DOCUMENTS

| | | | |
|---|---|---|---|
| 2006/0133927 | A1 | 6/2006 | Brillert et al. |
| 2008/0008574 | A1 | 1/2008 | Brillert |
| 2008/0063513 | A1 | 3/2008 | Afanasiev |
| 2008/0141677 | A1 | 6/2008 | Brillert |
| 2008/0181767 | A1 | 7/2008 | Brillert et al. |
| 2009/0116965 | A1 | 5/2009 | Brillert et al. |
| 2009/0142189 | A1 | 6/2009 | Kovac et al. |
| 2010/0014986 | A1 | 1/2010 | Traverso |
| 2010/0178173 | A1 | 7/2010 | Charlton |

* cited by examiner

WIRE SEAL FOR METERING OF TURBINE BLADE COOLING FLUIDS

CROSS-REFERENCE TO RELATED APPLICATION

This application claims priority to U.S. Provisional Patent Application No. 61/353,730, filed Jun. 11, 2010, the entirety of which is incorporated herein.

FIELD OF THE INVENTION

This invention is directed generally to turbine engines, and more particularly to cooling fluid feed systems in turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades and turbine vanes must be made of materials capable of withstanding such high temperatures. Turbine blades, vanes and other components often contain cooling systems for prolonging the life of these items and reducing the likelihood of failure as a result of excessive temperatures.

Typically, turbine vanes extend radially inward from a vane carrier and terminate within close proximity of a rotor assembly. Turbine blades are typically attached to a rotor assembly and extend radially outward. Turbine blades are often supplied with cooling fluids from cooling channels in the rotor assembly. Often times, the cooling channels include leakage points at which leak cooling fluids from the cooling fluid channels, which negatively effects the efficiency of the turbine engine. Thus, there exists a need for a more efficient cooling fluid feed system for the rotor assembly of a gas turbine engine.

SUMMARY OF THE INVENTION

This invention relates to a cooling fluid metering system for a turbine blade of a gas turbine engine. The cooling fluid metering system may include a cooling channel positioned between a root of a turbine blade and an offset rotor sealing plate for supplying cooling fluids to turbine blades. At one point, a portion of the cooling channel may include a gap between the root and the offset rotor sealing plate. The gap may be sealed with teardrop shaped seal positioned within a teardrop shaped cavity at the gap. The cavity and seal may be positioned such that during operation, the seal is forced radially outward and into the gap, thereby effectively metering cooling fluid flow, which may be, but is not limited to, cooling air, through the cooling channel. By metering the cooling fluid flow through the cooling channel, the amount of leakage flow can be reduced, thereby improving the overall engine performance without reducing the component durability.

The cooling fluid metering system is useful in a turbine engine to meter cooling fluids therein. The turbine engine may include a rotor assembly including at least one row of turbine blades extending radially outward from a rotor, wherein a root of at least one turbine blade is coupled to a rotor disc and extends radially outward therefrom. One or more rotor sealing plates may be offset axially from the root of the turbine blade such that a gap is formed between the rotor sealing plate and the root of the turbine blade. The gap may form a portion of a cooling fluid channel of a turbine blade cooling system.

A first axially extending seal arm may extend axially from the root of the turbine blade towards the rotor sealing plate having a radially inner surface positioned at an acute angle such that an axially outer end of the first axially extending seal arm is radially outward from an intersection between the radially inner surface and the turbine blade. The cooling fluid metering system may also include a second axially extending seal arm extending axially from the rotor disc towards the rotor sealing plate having a radially outer surface positioned at an acute angle such that an axially outer end of the second axially extending seal arm is radially outward from an intersection between the radially outer surface and the turbine blade. Each of the first axially extending seal arm, the second axially extending seal arm and the rotor sealing plate may form a portion of a seal cavity having a teardrop shaped cross-section. The teardrop shaped seal may fill at least a portion of the seal cavity and may be positioned in the seal cavity for metering cooling fluid flow through the cooling fluid channel and past the gap. The teardrop shaped seal may also include one or more holes therein for metering flow past the seal.

The teardrop shaped seal may include a first outer surface that bears against the radially inner surface of the first axially extending seal arm and a second outer surface that bears against the radially outer surface of the second axially extending seal arm, wherein the first and second outer surfaces are coupled together at a tip. The teardrop shaped seal may be formed from a material configured to conform to the radially inner surface of the first axially extending arm and the radially outer surface of the second axially extending arm during operation as centrifugal forces force the teardrop shaped seal radially outward to seal the gap. In one embodiment, the teardrop shaped seal may be formed from a wire seal. A radially outermost portion of the teardrop shaped cavity may be located at the gap between the rotor sealing plate and the root of the turbine blade. An outermost point of the first axially extending seal arm in an axial direction may be generally aligned with an outermost point of the second axially extending seal arm in the axial direction. The rotor sealing plate may include a generally linear outer surface opposing the first and second axially extending arms.

An advantage of this invention is that by metering the cooling fluid flow through the cooling channel, the amount of leakage flow can be reduced, thereby improving the overall engine performance without reducing the component durability.

Another advantage of this invention is that the teardrop shaped seal seals the gap with precision and accuracy.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
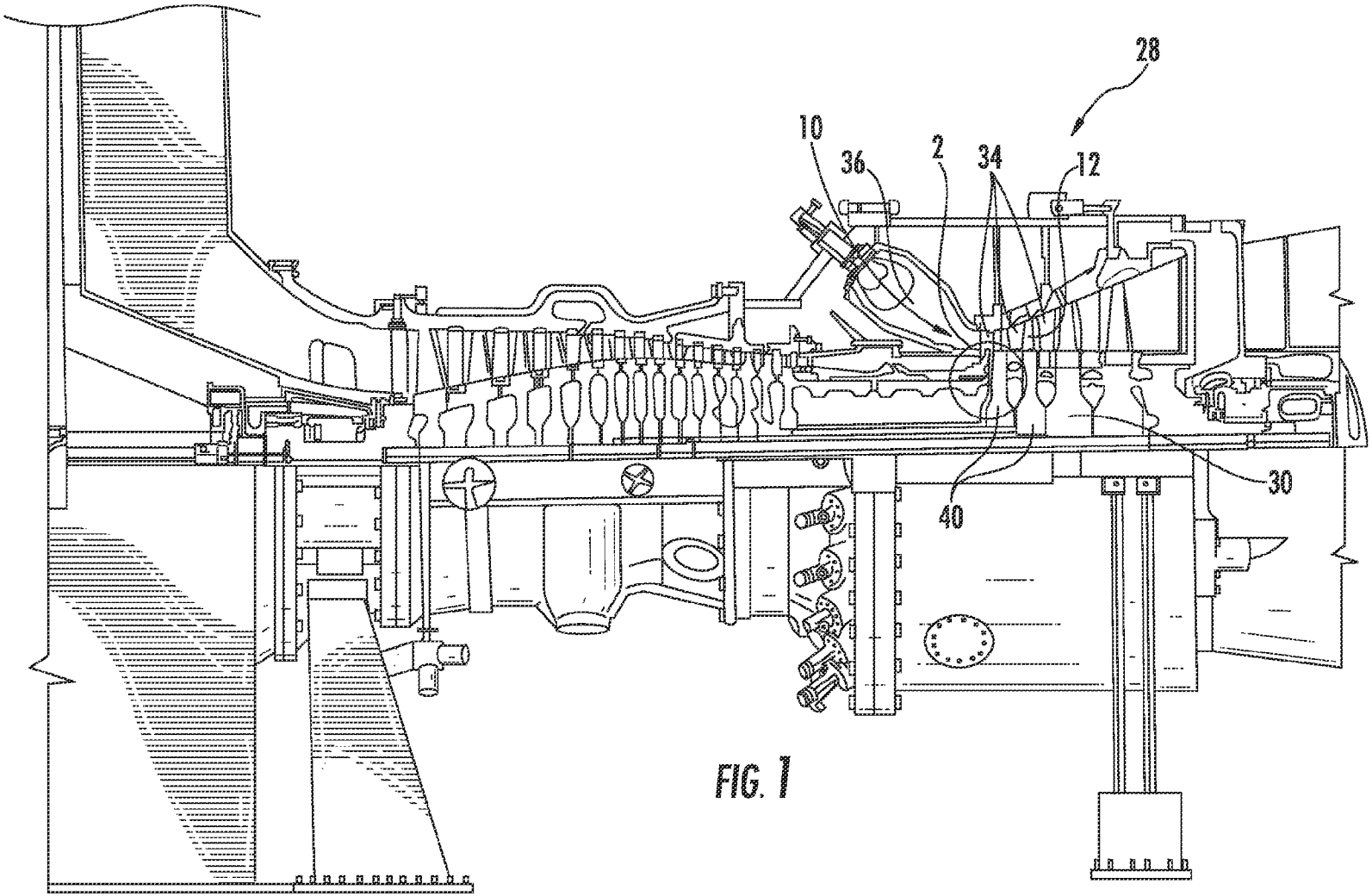
FIG. 1 is a cross-sectional side view of a portion of a turbine engine including a cooling fluid feed system of this invention.
Figure 2:
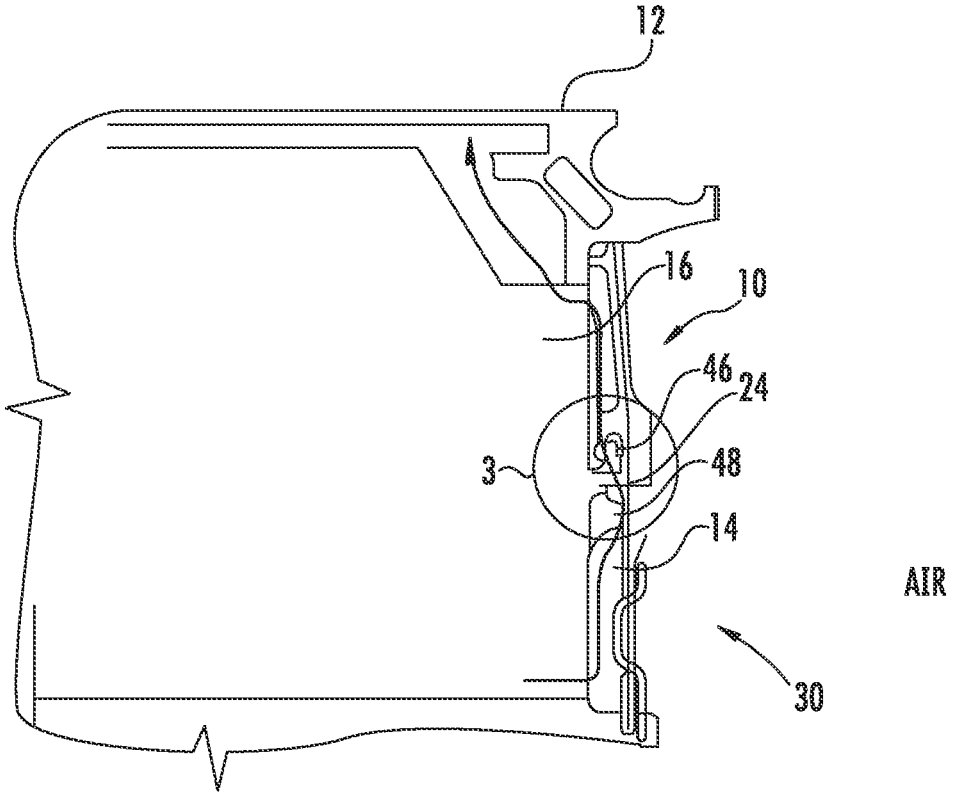
FIG. 2 is a partial cross-sectional view of a portion of the turbine engine shown in FIG. 1 at detail line 2.
Figure 3:
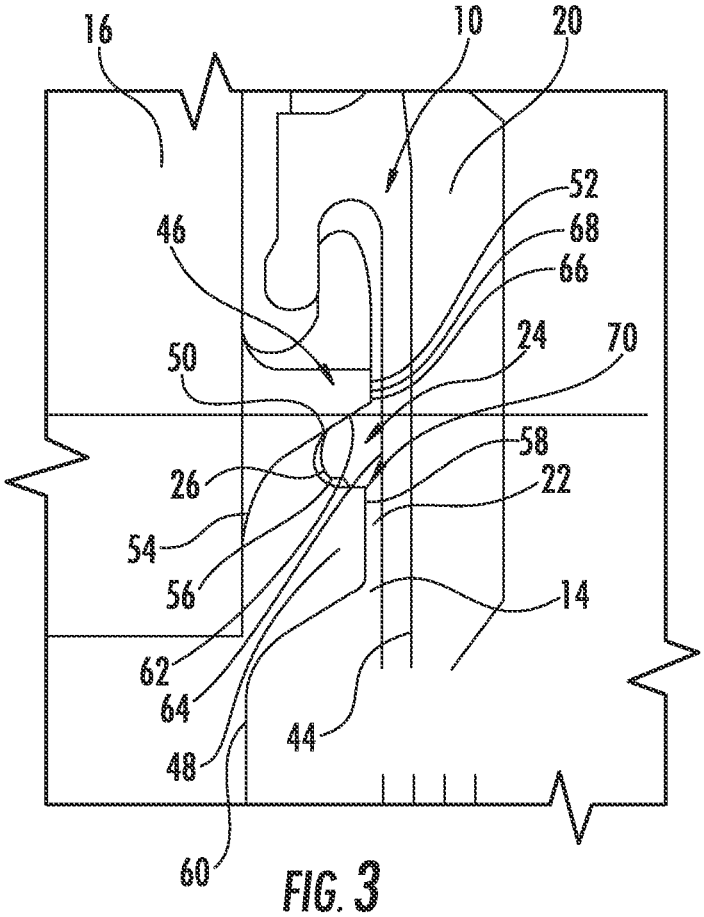
FIG. 3 is a partial cross-sectional view of the cooling fluid metering system of the turbine engine shown in FIG. 2 at detail line 3.

As shown in FIGS. 1-3, this invention is directed to a cooling fluid metering system 10 for a turbine blade 12 of a gas turbine engine 28. The cooling fluid metering system 10 may include a cooling channel 14 positioned between a root 16 of a turbine blade 12 and an offset rotor sealing plate 20 for supplying cooling fluids to turbine blades 12. At one point, a portion of the cooling channel 14 may include a gap 22 between the root 16 and the offset rotor sealing plate 20. The gap 22 may be sealed with teardrop shaped seal 24 positioned within a teardrop shaped cavity 26 at the gap 22. The cavity 26 and seal 24 may be positioned such that during operation, the seal 24 is forced radially outward and into the gap 22, thereby effectively metering cooling fluid flow, which may be, but is not limited to, cooling air, through the cooling channel 14. By metering the cooling fluid flow through the cooling channel 14, the amount of leakage flow can be reduced, thereby improving the overall engine performance without reducing the component durability.

As shown in FIGS. 1 and 2, the gas turbine engine 28 may include a rotor assembly 30 positioned radially inward from a vane carrier and turbine vanes 34. The rotor assembly 24 may include first and second rows of turbine blades 12, or more, extending radially outward from the rotor assembly 30. As shown in FIG. 1, the turbine blades 12 may be assembled into rows, which are also referred to as stages. Each turbine blade 12 may include a root 16 coupled to a rotor disc 40 and extending radially outward therefrom. The turbine engine 28 may also include one or more combustors 36 positioned upstream from the rotor assembly 30. The rotor assembly 30 may be configured to enable the rotor 30 to rotate relative to the vane carrier and turbine vanes 12. The turbine engine 28 may also include a compressor positioned upstream from the combustor 36. The cooling fluid metering system 10 may receive cooling fluids from the compressor as compressor exhaust.

As shown in FIGS. 2 and 3, a rotor sealing plate 20 may be offset axially from the root 16 of the turbine blade 12 such that the gap 22 is formed between the rotor sealing plate 20 and the root 16 of the turbine blade 12. The gap 22 may form a portion of the cooling channel 14 of the cooling fluid metering system 10. The rotor sealing plate 20 may include a generally linear outer surface 44 opposing first and second axially extending seal arms 46, 48.

As shown in FIG. 3, the first axially extending seal arm 46 may extending axially from the root 16 of the turbine blade 12 towards the rotor sealing plate 20 having a radially inner surface 50 positioned at an acute angle such that an axially outer end 52 of the first axially extending seal arm 46 is radially outward from an intersection 54 between the radially inner surface 50 and the turbine blade 12. Similarly, the second axially extending seal arm 48 may extend axially from the rotor disc 40 towards the rotor sealing plate 20 having a radially outer surface 56 positioned at an acute angle such that an axially outer end 58 of the second axially extending seal arm 48 is radially outward from an intersection 60 between the radially outer surface 56 and the turbine blade 12. In one embodiment, each of the first axially extending seal arm 46, the second axially extending seal arm 48 and the rotor sealing plate 20 form a portion of a seal cavity 26 having a teardrop shaped cross-section. The first and second axially extending arms 46, 48 may be configured such that an outermost point 52 of the first axially extending seal arm 46 in an axial direction is generally aligned with an outermost point 58 of the second axially extending seal arm 48 in the axial direction.

A teardrop shaped seal 24 may be positioned in the seal cavity 26 for metering cooling fluid flow through the cooling fluid channel 14 and past the gap 22. The teardrop shaped seal 24 may be formed from a wire seal or other appropriate seal. As shown in FIG. 3, the teardrop shaped seal 24 may include a first outer surface 62 that bears against the radially inner surface 50 of the first axially extending seal arm 46 and a second outer surface 64 that bears against the radially outer surface 56 of the second axially extending seal arm 48. The first and second outer surfaces 62, 64 may be coupled together at a tip 66. In at least one embodiment, the teardrop shaped seal 24 may be formed from a material configured to conform to the radially inner surface 50 of the first axially extending arm 46 and the radially outer surface 56 of the second axially extending arm 48 during operation as centrifugal forces force the teardrop shaped seal 24 radially outward to seal the gap 22. A radially outermost portion 68 of the teardrop shaped cavity 26 is located at the gap 22 between the rotor sealing plate 20 and the root 16 of the turbine blade 12. The teardrop shaped seal 24 may also include one or more holes 70 therein for metering flow past the seal 24, as shown in FIG. 3.

During use, cooling fluids, such as, but not limited to, air, may flow from the compressor and into the cooling channel 14. The cooling fluids may be pumped radially outward within the cooling channel 14. As the rotor assembly 30 begins to rotate and centrifugal forces develop, the centrifugal forces cause the teardrop shaped seal 24 to be pressed into the gap 22 such that the gap is sealed by the teardrop shaped seal 24. In one embodiment, the first outer surface 62 may bear against the radially inner surface 50 of the first axially extending seal arm 46 or the second outer surface 64 may bear against the radially outer surface 56 of the second axially extending seal arm 48, or both. As such, the cooling fluid flow through the cooling channel 14 is metered, and thus, the amount of leakage flow can be reduced, thereby improving the overall engine performance without reducing the component durability.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine engine, comprising:

a rotor assembly including at least one row of turbine blades extending radially outward from a rotor, wherein a root of at least one turbine blade is coupled to a rotor disc and extends radially outward therefrom;

at least one rotor sealing plate offset axially from the root of the at least one turbine blade such that a gap is formed between the rotor sealing plate and the root of the at least one turbine blade; wherein the gap forms a portion of a cooling fluid channel of a turbine blade cooling system;

a first axially extending seal arm extending axially from the root of the turbine blade towards the rotor sealing plate having a radially inner surface positioned at an acute angle such that an axially outer end of the first axially extending seal arm is radially outward from an intersection between the radially inner surface and the turbine blade;

a second axially extending seal arm extending axially from the rotor disc towards the rotor sealing plate having a radially outer surface positioned at an acute angle such that an axially outer end of the second axially extending seal arm is radially outward from an intersection between the radially outer surface and the turbine blade;

wherein each of the first axially extending seal arm, the second axially extending seal arm and the rotor sealing plate form a portion of a seal cavity having a teardrop shaped cross-section; and a teardrop shaped seal filling at least a portion of the seal cavity and positioned in the seal cavity for metering cooling fluid flow through the cooling fluid channel and past the gap.

2. The turbine engine of claim 1, wherein the teardrop shaped seal is formed from a wire seal.

3. The turbine engine of claim 1, wherein the teardrop shaped seal includes a first outer surface that bears against the radially inner surface of the first axially extending seal arm and a second outer surface that bears against the radially outer surface of the second axially extending seal arm, wherein the first and second outer surfaces are coupled together at a tip.

4. The turbine engine of claim 1, wherein the teardrop shaped seal is formed from a material configured to conform to the radially inner surface of the first axially extending arm and the radially outer surface of the second axially extending arm during operation as centrifugal forces force the teardrop shaped seal radially outward to seal the gap.

5. The turbine engine of claim 1, wherein a radially outermost portion of the teardrop shaped cavity is located at the gap between the rotor sealing plate and the root of the at least one turbine blade.

6. The turbine engine of claim 1, wherein an outermost point of the first axially extending seal arm in an axial direction is generally aligned with an outermost point of the second axially extending seal arm in the axial direction.

7. The turbine engine of claim 1, wherein the rotor sealing plate includes a generally linear outer surface opposing the first and second axially extending arms.

8. The turbine engine of claim 1, wherein the teardrop shaped seal includes at least one hole extending through the seal for metering the flow of cooling fluids therethrough.

9. A fluid cooling rotor assembly for a turbine engine, comprising:

a rotor assembly including at least one row of turbine blades extending radially outward from a rotor, wherein a root of at least one turbine blade is coupled to a rotor disc and extends radially outward therefrom;

at least one rotor sealing plate offset axially from the root of the at least one turbine blade such that a gap is formed between the rotor sealing plate and the root of the at least one turbine blade; wherein the gap forms a portion of a cooling fluid channel of a turbine blade cooling system;

a first axially extending seal arm extending axially from the root of the turbine blade towards the rotor sealing plate having a radially inner surface positioned at an acute angle such that an axially outer end of the first axially extending seal arm is radially outward from an intersection between the radially inner surface and the turbine blade;

a second axially extending seal arm extending axially from the rotor disc towards the rotor sealing plate having a radially outer surface positioned at an acute angle such that an axially outer end of the second axially extending seal arm is radially outward from an intersection between the radially outer surface and the turbine blade;

wherein each of the first axially extending seal arm, the second axially extending seal arm and the rotor sealing plate form a portion of a seal cavity having a teardrop shaped cross-section;

a teardrop shaped seal filling at least a portion of the seal cavity and positioned in the seal cavity for metering cooling fluid flow through the cooling fluid channel and past the gap.

10. The fluid cooling rotor assembly of claim 9, wherein the teardrop shaped seal includes at least one hole extending through the seal for metering the flow of cooling fluids therethrough.

11. The fluid cooling rotor assembly of claim 9, wherein the teardrop shaped seal includes a first outer surface that bears against the radially inner surface of the first axially extending seal arm and a second outer surface that bears against the radially outer surface of the second axially extending seal arm, wherein the first and second outer surfaces are coupled together at a tip.

12. The fluid cooling rotor assembly of claim 9, wherein the teardrop shaped seal is formed from a material configured to conform to the radially inner surface of the first axially extending arm and the radially outer surface of the second axially extending arm during operation as centrifugal forces force the teardrop shaped seal radially outward to seal the gap.

13. The fluid cooling rotor assembly of claim 9, wherein a radially outermost portion of the teardrop shaped cavity is located at the gap between the rotor sealing plate and the root of the at least one turbine blade.

14. The fluid cooling rotor assembly of claim 9, wherein an outermost point of the first axially extending seal arm in an axial direction is generally aligned with an outermost point of the second axially extending seal arm in the axial direction.

15. The fluid cooling rotor assembly of claim 8, wherein the rotor sealing plate includes a generally linear outer surface opposing the first and second axially extending arms.

16. A turbine engine, comprising:

a rotor assembly including at least one row of turbine blades extending radially outward from a rotor, wherein a root of at least one turbine blade is coupled to a rotor disc and extends radially outward therefrom;

at least one rotor sealing plate offset axially from the root of the at least one turbine blade such that a gap is formed between the rotor sealing plate and the root of the at least one turbine blade; wherein the gap forms a portion of a cooling fluid channel of a turbine blade cooling system;

a first axially extending seal arm extending axially from the root of the turbine blade towards the rotor sealing plate having a radially inner surface positioned at an acute angle such that an axially outer end of the first axially extending seal arm is radially outward from an intersection between the radially inner surface and the turbine blade;

a second axially extending seal arm extending axially from the rotor disc towards the rotor sealing plate having a radially outer surface positioned at an acute angle such that an axially outer end of the second axially extending seal arm is radially outward from an intersection between the radially outer surface and the turbine blade;

wherein each of the first axially extending seal arm, the second axially extending seal arm and the rotor sealing plate form a portion of a seal cavity having a teardrop shaped cross-section; and a teardrop shaped seal filling at least a portion of the seal cavity and positioned in the seal cavity for metering cooling fluid flow through the cooling fluid channel and past the gap, wherein the teardrop shaped seal includes a first outer surface that bears against the radially inner surface of the first axially extending seal arm and a second outer surface that bears against the radially outer surface of the second axially extending seal arm, wherein the first and second outer surfaces are coupled together at a tip; and wherein the teardrop shaped seal is formed from a material configured to conform to the radially inner surface of the first axially extending arm and the radially outer surface of the second axially extending arm during operation as centrifugal forces force the teardrop shaped seal radially outward to seal the gap.

17. The turbine engine of claim 16, wherein the teardrop shaped seal includes at least one hole extending through the seal for metering the flow of cooling fluids therethrough.

18. The turbine engine of claim 16, wherein a radially outermost portion of the teardrop shaped cavity is located at the gap between the rotor sealing plate and the root of the at least one turbine blade.

19. The turbine engine of claim 16, wherein an outermost point of the first axially extending seal arm in an axial direction is generally aligned with an outermost point of the second axially extending seal arm in the axial direction.

20. The turbine engine of claim 16, wherein the rotor sealing plate includes a generally linear outer surface opposing the first and second axially extending arms.

* * * * *